US011824295B2

(12) United States Patent
Moncher et al.

(10) Patent No.: US 11,824,295 B2
(45) Date of Patent: Nov. 21, 2023

(54) ELECTRICAL PLUG WITH A SPECIFIC PIN ARRANGEMENT COMPRISING EIGHT DATA TRANSMISSION CONTACTS FOR GIGABIT APPLICATION

(71) Applicant: TE Connectivity Industrial GmbH, Niederwinkling (DE)

(72) Inventors: Philipp Moncher, Niederwinkling (DE); Sebastian Achatz, Niederwinkling (DE); Christopher Solcher, Niederwinkling (DE); Siegfried Funk, Niederwinkling (DE)

(73) Assignee: TE Connectivity Industrial GmbH, Niederwinkling (DE)

( * ) Notice: Subject to any disclaimer, the term of this patent is extended or adjusted under 35 U.S.C. 154(b) by 20 days.

(21) Appl. No.: 17/501,109

(22) Filed: Oct. 14, 2021

(65) Prior Publication Data

US 2022/0123489 A1 Apr. 21, 2022

(30) Foreign Application Priority Data

Oct. 15, 2020 (EP) ..... 20202065

(51) Int. Cl.
*H01R 13/04* (2006.01)
*H01B 11/08* (2006.01)
(Continued)

(52) U.S. Cl.
CPC ..... *H01R 13/04* (2013.01); *H01B 11/08* (2013.01); *H01R 13/516* (2013.01);
(Continued)

(58) Field of Classification Search
CPC .... H01R 13/04; H01R 13/516; H01R 13/512; H01R 107/00
(Continued)

(56) References Cited

U.S. PATENT DOCUMENTS 8,029,322 B1 * 10/2011 Oh ..... H01R 13/426 439/695
8,753,133 B1 * 6/2014 Errato, Jr. ..... H01R 13/562 439/95
(Continued)

FOREIGN PATENT DOCUMENTS

DE 296 17 113 U1 11/1996
DE 10 2017 012 173 A1 7/2018
(Continued)

OTHER PUBLICATIONS

Extended European Search Report, Application No. 20202065.7-1201, dated Mar. 2, 2021, 10 pages.
(Continued)

*Primary Examiner* — Alexander Gilman
(74) *Attorney, Agent, or Firm* — Barley Snyder

(57) ABSTRACT

An electrical plug includes a pair of electrical energy transmission contacts that are separate from one another, a plurality of signal transmission contacts that are separate from one another, and at least eight data transmission contacts that are separate from one another. An arrangement of the electrical energy transmission contacts, the signal transmission contacts, and the data transmission contacts forms a pin arrangement of the electrical plug.

20 Claims, 7 Drawing Sheets

(51) Int. Cl.
*H01R 13/516* (2006.01)
*H01R 13/512* (2006.01)
*H01R 107/00* (2006.01)

(52) U.S. Cl.
CPC ..... *H01R 13/512* (2013.01); *H01R 2107/00* (2013.01); *H01R 2201/10* (2013.01)

(58) Field of Classification Search
USPC ..... 439/345
See application file for complete search history.

(56) References Cited

U.S. PATENT DOCUMENTS

| | | | | |
|---|---|---|---|---|
| 9,306,333 | B2 * | 4/2016 | Dang | H01R 13/6461 |
| 9,437,965 | B2 * | 9/2016 | Zitsch | H01R 24/28 |
| 9,728,902 | B2 | 8/2017 | Hoher et al. | |
| 10,249,411 | B2 * | 4/2019 | Kunz | H01B 11/20 |
| 10,256,565 | B2 * | 4/2019 | Kraemer | H01R 13/111 |
| 10,361,516 | B2 * | 7/2019 | Freer | H01R 13/641 |
| 10,511,121 | B2 * | 12/2019 | Milroy | H01R 13/5221 |
| 2010/0319956 | A1 * | 12/2010 | Ballard | H01B 9/003 174/105 R |
| 2014/0162491 | A1 * | 6/2014 | Valadas | H01H 36/0046 439/488 |
| 2014/0227900 | A1 * | 8/2014 | Zitsch | H01R 13/62 439/359 |
| 2014/0242840 | A1 * | 8/2014 | Dang | H01R 13/6586 439/607.01 |
| 2015/0270647 | A1 * | 9/2015 | Hoher | H01R 13/6582 439/607.05 |
| 2017/0054596 | A1 * | 2/2017 | Murray | H04L 45/60 |
| 2017/0279210 | A1 * | 9/2017 | Kraemer | H01R 13/506 |
| 2018/0248322 | A1 * | 8/2018 | Foran | H01R 24/40 |
| 2019/0027857 | A1 * | 1/2019 | Narberhaus | H01R 13/6591 |
| 2019/0334297 | A1 * | 10/2019 | Kunz | H01R 24/40 |
| 2019/0393652 | A1 * | 12/2019 | Edenhofer | H01R 13/652 |
| 2020/0176919 | A1 * | 6/2020 | DeWitt | H01R 13/512 |
| 2021/0013660 | A1 * | 1/2021 | Markefka | H01R 13/42 |
| 2021/0028583 | A1 * | 1/2021 | Lachelli | H01R 13/6597 |
| 2021/0151942 | A1 * | 5/2021 | Dobler | H01R 13/6272 |
| 2021/0226390 | A1 * | 7/2021 | Blakborn | H01R 13/6456 |
| 2021/0281022 | A1 * | 9/2021 | Moncher | H01R 24/86 |
| 2022/0123489 | A1 * | 4/2022 | Moncher | H01B 11/08 |
| 2022/0289051 | A1 * | 9/2022 | Huang | H01R 24/30 |
| 2022/0302637 | A1 * | 9/2022 | Burrow | H01R 13/533 |
| 2022/0399677 | A1 * | 12/2022 | Hoffmann | H01R 13/5202 |

FOREIGN PATENT DOCUMENTS

| | | | |
|---|---|---|---|
| EP | 3657614 | A1 | 5/2020 |
| JP | 2015528636 | W | 9/2015 |
| JP | 2019003876 | A | 1/2019 |
| JP | 3226959 | U | 7/2020 |

OTHER PUBLICATIONS

Office Action from the Japan Patent Office dated Dec. 6, 2022, corresponding to Application No. 2021-167093 with English translation, 11 pages.

* cited by examiner

ELECTRICAL PLUG WITH A SPECIFIC PIN ARRANGEMENT COMPRISING EIGHT DATA TRANSMISSION CONTACTS FOR GIGABIT APPLICATION

CROSS-REFERENCE TO RELATED APPLICATIONS

This application claims the benefit of the filing date under 35 U.S.C. § 119(a)-(d) of European Patent Application No. 20202065.7, filed on Oct. 15, 2020.

FIELD OF THE INVENTION

The present invention relates to an electrical plug and, more particularly, to an electrical plug with a specific pin arrangement.

BACKGROUND

Electrical plugs are known in numerous designs. For instance it is known that, by electrical plugs, electric motors are contacted. In this connection via energy transmission contacts, also referred to as power contacts, electrical energy can be transmitted from the motor or to the motor, respectively. Via signal transmission contacts, signals can be transmitted which are different from energy signals, namely for instance control signals or information signals. Further electrical plugs could be used for so called daisy chains. Electrical plugs can also connect to a controller.

When coupling several motors, it is also required that via the corresponding chain a sufficient and thus substantially constant energy transmission, on the one hand, and a transmission of communication signals, on the other hand, is facilitated. Thereby, high demands are made on such electrical plugs. In particular this also applies to the requirement of a high voltage stability and a high ampacity.

SUMMARY

An electrical plug includes a pair of electrical energy transmission contacts that are separate from one another, a plurality of signal transmission contacts that are separate from one another, and at least eight data transmission contacts that are separate from one another. An arrangement of the electrical energy transmission contacts, the signal transmission contacts, and the data transmission contacts forms a pin arrangement of the electrical plug.

BRIEF DESCRIPTION OF THE DRAWINGS

The invention will now be described by way of example with reference to the accompanying Figures, of which.

DETAILED DESCRIPTION OF THE EMBODIMENT(S)

Features of the invention are apparent from the claims, the figures, and the description of figures. The features and feature combinations mentioned herein and/or shown in the figures alone are usable not only in the respectively specified combination, but also in other combinations or taken alone without departing from the scope of the invention. Thus, implementations are also to be considered as encompassed and disclosed by the invention, which are not explicitly shown in the figures and explained, but arise from and can be generated by the separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations described herein, which extend beyond or deviate from the feature combinations set out in the claims.

In the figures, same elements or elements having the same function have the same reference signs. With the indications "top", "bottom", "front", "rear", "horizontal", "vertical", "depth direction", "width direction", "height direction" the positions and orientations given in the case of intended use and intended arrangement of the plug are indicated, but are not intended to limit the disclosure to the shown orientation.

Figure 1:
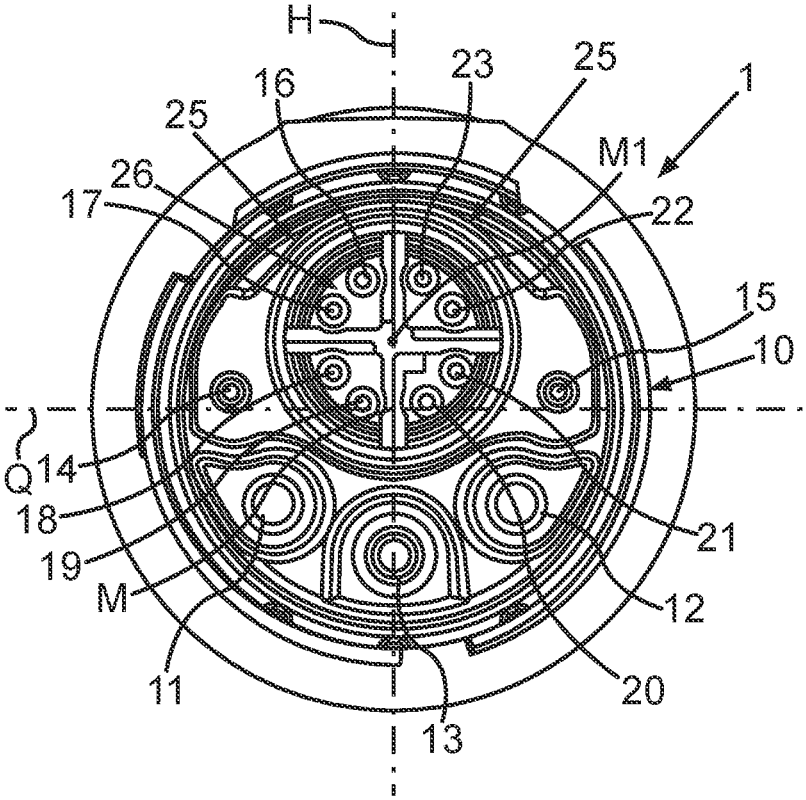
FIG. 1 is a front view of an electrical plug with a pin arrangement according to an embodiment.

In FIG. 1, an electrical plug 1 according to an embodiment is shown. The electrical plug 1 may, for instance, intentionally be provided for connecting to a housing part of an electric motor. The electrical plug 1 may for instance be an angle plug; in FIG. 3 a perspective view of such an angle plug is shown. A further aspect of the invention relates to an arrangement comprising an electrical plug 1 as described herein and the at least one housing part of a housing for the electric motor.

Figure 3:
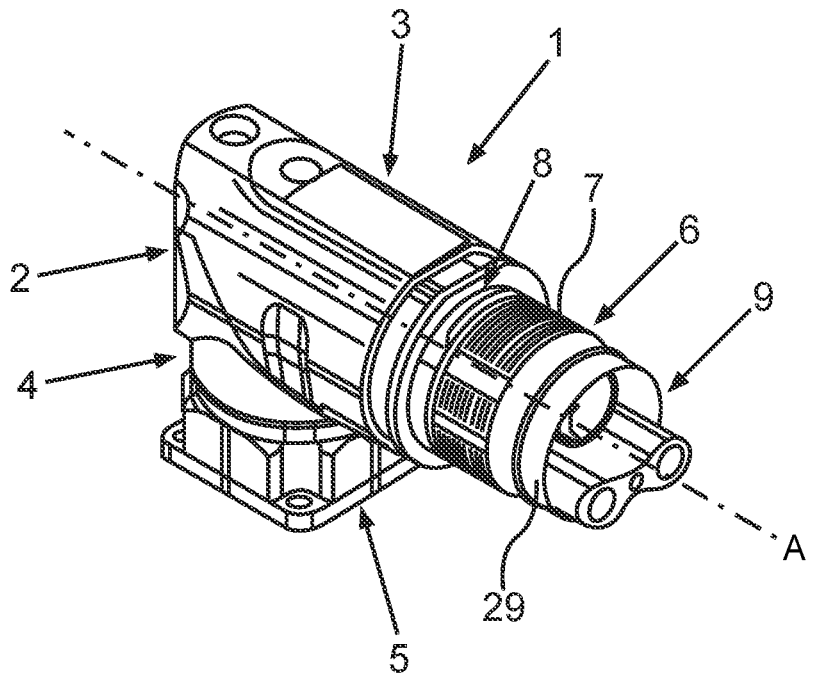
FIG. 3 is a perspective view of an electrical plug according to an embodiment with the pin arrangement of FIG. 1 or FIG. 2.

The electrical plug 1 according to FIG. 3 comprises a plug housing 2, which has a first plug housing section 3 and a second plug housing section 4. The two tube-like plug housing sections 3 and 4 are arranged at an angle relative to each other. In an embodiment, this angle is 90°. In other embodiment, the angle is between 80° and 100°.

In the embodiment shown in FIG. 3, the electrical plug 1 also comprises a flange sleeve 5, which is connected with the second plug housing section 4. By the flange sleeve 5, the electrical plug 1 can be attached on the outer side to the housing part of the electric motor. In particular it may be screwed thereto. A different attachment of the electrical plug 1 to the housing part is also possible. For instance, in this connection a simple plug connection is provided. In this connection, an attachment of the electrical plug 1 to the housing part, in particular a plug socket of the housing part, can be facilitated only be such plug connection. Complex thread screw attachments or attachments by additional separate screws can then be avoided.

As can also be recognized in FIG. 3, the electrical plug 1 at a free end 9 of the first plug housing section 3 has a coupling possibility to further components. For instance, a further plug may be connected thereto. To this end, on an outer portion 6 of the tube-like first plug housing section 3, a thread 7 and/or a bayonet coupling 8 is configured. Thus, optionally a mechanical coupling to another plug by the thread 7 or the bayonet coupling 8 can be achieved. This coupling possibility is configured according to an M12 X Code Standard.

The first plug housing section 3 has a longitudinal axis A. This electrical plug 1 in one embodiment comprises a pin arrangement according to FIG. 1. In FIG. 1, in one embodiment, a top view in the direction of the longitudinal axis A at the free end 9 is shown. As can be recognized in FIG. 1, the pin arrangement 10 of this electrical plug 1 comprises a first energy transmission contact 11. Moreover, it comprises a second electrical energy transmission contact 12. Moreover, an electrical ground contact 13 is provided. By the energy transmission contacts 11 and 12, energy transmission signals are transmitted.

As can be discerned, the pin arrangement 10 has a height axis H, as shown in FIG. 1, which is oriented perpendicularly to the longitudinal axis A. In a view from the front at the pin arrangement 10 as in FIG. 1, this height axis H is a vertical axis. It extends through a center M of this entire pin arrangement 10 of this round plug geometry. The round plug geometry is shown in FIG. 1. In an embodiment, the corresponding electrical plug is an M12 plug.

As shown in FIG. 1, the energy transmission contacts 11 and 12 are arranged symmetrically to the height axis H. The ground contact 13 is arranged directly on this height axis H.

In the embodiment shown in FIG. 1, the pin arrangement 10 comprises two signal transmission contacts 14 and 15. The two signal transmission contacts 14 and 15 are different from the energy transmission contacts 11 and 12; they are here configured to be thinner in diameter than the energy transmission contacts 11 and 12. By the signal transmission contacts 14 and 15, no energy transmission signals are transmitted. Rather, signals for controlling functional components and/or for transmitting information from these functional components, for example from an electric motor, are transmitted by the signal transmission contacts 14 and 15. The signal transmission contacts 14 and 15 are not data transmission contacts. The transmission rate for the signal transmission contacts 14 and 15 is smaller, in particular many times smaller than in the case of data transmission contacts. In an embodiment, the signal transmission contacts 14 and 15 are not gigabit data transmission contacts, but transmit direct voltage or alternating voltage signals.

In an embodiment, the pin arrangement 10 comprises exactly two signal transmission contacts 14 and 15. The signal transmission contacts 14 and 15 may be intentionally provided for signal transmission of functional units of an electric motor. Especially analogue signals. Such functional unit may for instance be a motor brake function or a brake mechanism. Thus, the electric motor can be specifically controlled in order to slow down or to accelerate. A further functional unit may for instance be the temperature sensor of the electric motor. In this connection thus signals of this temperature sensor can be transmitted via these signal transmission contacts 14 and 15. In a further embodiment, the signal transmission contacts 14 and 15 may be intentionally provided and used for the transmission of signals for an overload protection for the electric motor.

As shown in FIG. 1, the two signal transmission contacts 14 and 15 are configured to be symmetrical to this height axis H. In relation to a transverse axis Q, which in FIG. 1 is a horizontal axis and which equally extends through the center M, the two signal transmission contacts 14 and 15 are arranged in a first pin arrangement half, in particular a top pin arrangement half. The energy transmission contacts 11 and 12 as well as the ground contact 13 are arranged in a pin arrangement half that is different therefrom, in particular, the lower pin arrangement half.

In the embodiment shown in FIG. 1, the pin arrangement 10 has several data transmission contacts. In the embodiment eight, in particular exactly eight, data transmission contacts 16, 17, 18, 19, 20, 21, 22, and 23 are configured. These data transmission contacts 16 to 23 are gigabit data transmission contacts. This means that they are configured for data transmission at a transmission rate of at least 1 Gbit/s, in particular a data transmission rate of at least 5 Gbit/s. In one embodiment, the here eight data transmission contacts 16 to 23 each are combined in data transmission contact pairs. In the embodiment this means that the data transmission contacts 16 and 17 form a data transmission contact pair. Equally, the data transmission contact 18 and 19 form a data transmission contact pair. Moreover, the data transmission contacts 20 and 21 form a data transmission contact pair. And not least also the data transmission contacts 22 and 23 form a data transmission contact pair.

The respective data transmission contacts 16, 17, 18, 19, 20, 21, 22, and 23 are coupled. Thus, a corresponding data transmission can be effected jointly via this data transmission contact pair. This is advantageous in order to achieve a higher data transmission rate. Moreover, by such embodiment the security of the data transmission is increased and a lower susceptibility to failure is achieved.

A comprehensive information transmission from an electric motor via the electrical plug 1 to another component can be effected. In this connection, the electrical plug is provided for bidirectional transmission of data at a data transmission rate of at least 1 Gbit/s. The data transmission rate designates the amount of digital data transmitted within a time span via a transmission channel. The amount of data therein is a measure for the amount of data. The basic unit of the amount of data is bit. Data here is to be understood as digital information. The data transmission contacts thus are intentionally provided and configured for transmitting digital signals.

In this connection, it is also envisaged in the embodiment of FIG. 1 that two each of the eight data transmission contacts 16 to 23 are arranged in a quarter segment. Here four quarter segments are shown. These quarter segments are configured to be separate from each other and of equal size. In an embodiment, two data transmission contacts 16 to 23 are arranged in each quarter segment.

In an embodiment, the named electrical contacts are arranged asymmetrically to a horizontal axis Q of the pin arrangement 10. This, too, is to be seen with respect to viewing the pin arrangement 10 from the front, as shown in FIG. 1. In one embodiment, the data transmission contacts 16 to 23 are arranged to be positioned higher than the energy transmission contacts 11 and 12, if viewing the pin arrangement 10 in the direction of the height axis H and from the front. Viewed in the direction of this height axis H, the at least two signal transmission contacts 14 and 15 are arranged to be overlapping or arranged in the region of the extension of the data transmission contacts 16 to 23. In one embodiment, the data transmission contacts 16 to 23 are not arranged symmetrically around a center point M of the pin arrangement 10. A center point M of the data transmission contacts 16 to 23 thus is not equal to the center point of the entire pin arrangement 10. In particular also the transverse axis Q subdivides the entire pin arrangement 10 of the plug into a first and a second pin arrangement half.

Figure 6:
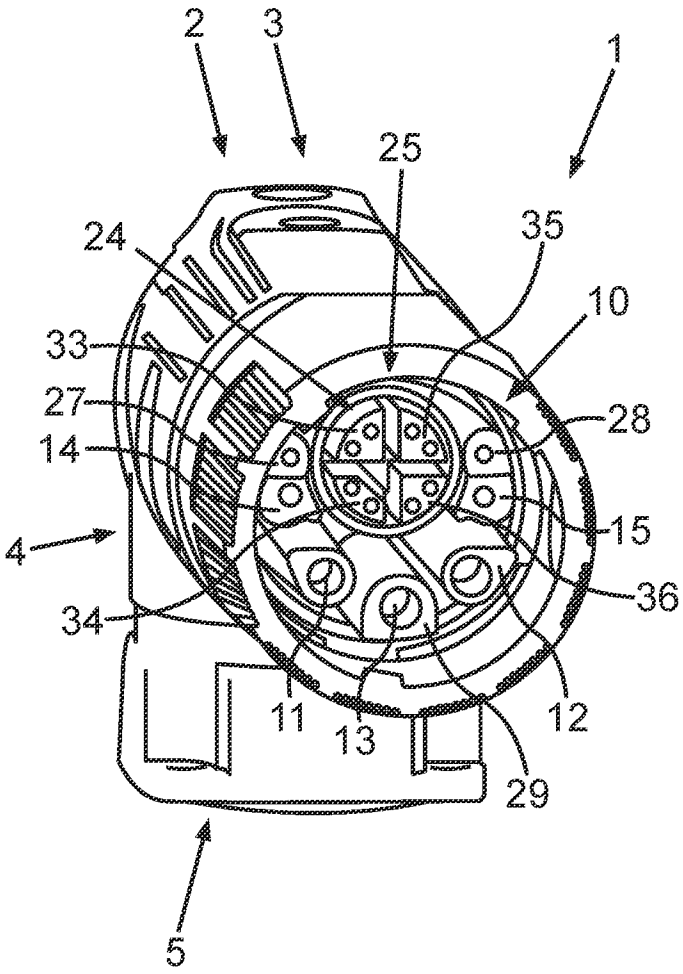
FIG. 6 is a perspective view of the electrical plug with the pin arrangement according to FIG. 2.
Figure 7:
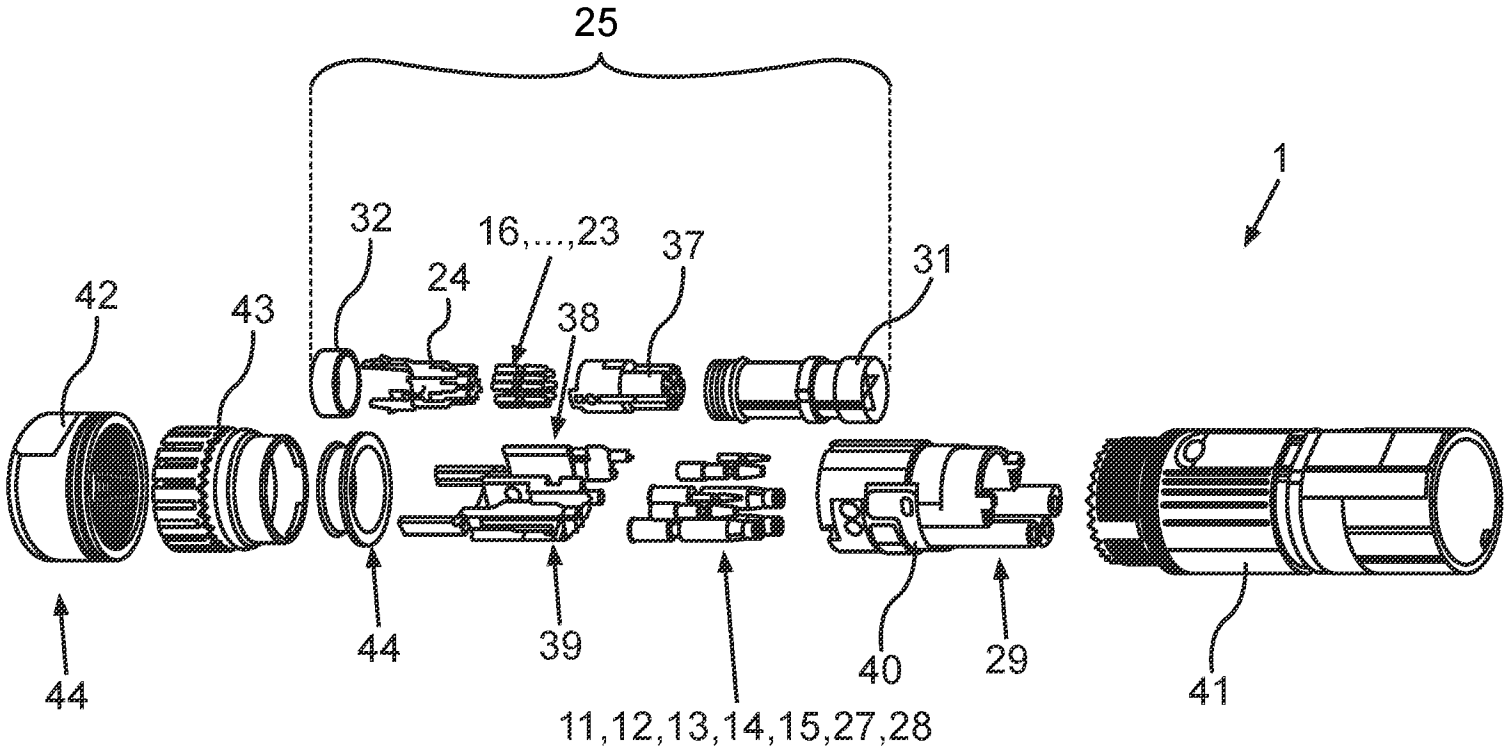
FIG. 7 is an exploded perspective view of the electrical plug of FIG. 6.

In particular a first contact carrier 24 of the electrical plug 1 is provided, as shown in FIGS. 6 and 7, which comprises these separated quarter segments as coupling structure for coupling to other plugs. This first contact carrier 24 is configured to be formed in particular as a single piece from plastic. The quarter segments, however, may also be integral parts of a sleeve 37 (FIG. 7) of a data transmission module 25 of the electrical plug 1. This sleeve 37 is separate to the first contact carrier 24. The first contact carrier 24 is then included in the sleeve 37.

In the embodiment shown in FIG. 1, the electrical plug 1 comprises the data transmission module 25. This data transmission module 25 comprises these here eight data transmission contacts 16 to 23. The data transmission module 25 is here configured with a round plug profile. The data transmission module 25 is fully integrated in the pin arrangement 10. This also means that a corresponding own pin arrangement of this data transmission module 25 is arranged completely within the surface of the entire pin arrangement 10 of the plug 1.

The pin arrangement 26 of this data transmission module 25 comprises these here eight data transmission contacts 16 to 23. The pin arrangement 26 of this data transmission module 25 has a center M1. In an embodiment, the pin arrangement 26 is a round arrangement, which is comprised in the round arrangement of the pin arrangement 10. Around this center M1, the here eight data transmission contacts 16 to 23 are arranged. They are arranged with equal radius to this center M1. The center M1 of the pin arrangement 26 is different from the center M of the pin arrangement 10. In one embodiment, the center M1 is in the top pin arrangement half of the pin arrangement 10. In particular all eight data transmission contacts 16 to 23 are in the top pin arrangement half of the pin arrangement 10.

In an embodiment the several, in particular eight, data transmission contacts 16 to 23 are arranged in one circle around a center point M1 of these data transmission contacts 16 to 23. The center point M1 of the data transmission contacts 16 to 23 is a center point of the data transmission module 25.

In an embodiment, as it is shown in FIG. 1, the center M1 is arranged on the height axis H. In one embodiment the here eight data transmission contacts 16 to 23 are arranged symmetrically to this height axis H. This means that, each symmetrical to each other, four data transmission contacts 16 to 19, are arranged on a side relative to the height axis H and the other data transmission contacts 20 to 23 are arranged on the other side of this height axis H.

In the here eight data transmission contacts 16 to 23, two data transmission contacts each are configured to connect to twisted pair wires. In one embodiment, the eight data transmission contacts 16 to 23 are arranged according to the X Code Standard in the pin arrangement. In particular here an M12 X Code is realized. This means that the electrical plug 1 is an M12 plug, which has the data transmission contacts arranged or comprises them according to the X Code Standard. The flexibility and the range of uses of such M12 plug is clearly increased by this integration of several data transmission contacts 16 to 23, in particular eight data transmission contacts, which allow for a data transmission rate of at least 1 Gbit/s. In particular thus an M12 X Code is provided as plug type. M12 plugs are electrical plugs comprising in particular a 12 mm screw thread as connection for other components. This is in this regard correspondingly standardized or normalized in terms of size.

As shown in FIG. 1, the signal transmission contacts 14 and 15, viewed perpendicularly to the height axis H, are more distant from this height axis H than all data transmission contacts 16 to 23.

Figure 2:
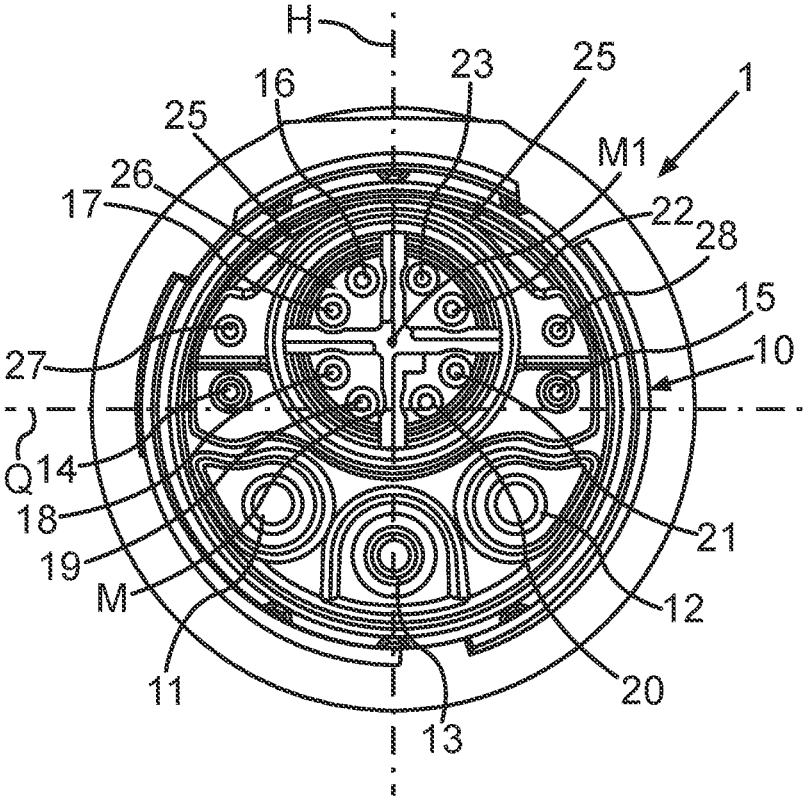
FIG. 2 is a front view of an electrical plug with a pin arrangement according to another embodiment.

In FIG. 2, a further embodiment of an electrical plug 1 is shown. In FIG. 2, the pin arrangement 10 is shown in a view as it has also been set out with regard to FIG. 1. In contrast to FIG. 1, in the embodiment of FIG. 2 not only two signal transmission contacts 14 and 15, but rather four separate signal transmission contacts 14, 15, 27, and 28, are comprised in the pin arrangement 10. All four signal transmission contacts 14, 15, 27, and 28 are here configured in a top pin arrangement half of the pin arrangement 10. The four signal transmission contacts 14, 15, 27, 28 are arranged symmetrically to the height axis H. They are all arranged at a distance, which is measured perpendicularly to the height axis H and which is larger than a respective corresponding distance of all data transmission contacts 16 to 23.

In FIG. 3, the electrical plug 1 shown therein has a design of the pin arrangement 10 as it is for instance shown in FIG. 1 or in FIG. 2. The electrical plug 1 comprises an outer sleeve 29. The outer sleeve 29 is formed from plastic. The tube-like outer sleeve 29 is separate from the first plug housing section 3. The first plug housing section 3 is made of metal, for example from die cast metal. The tube-like outer sleeve 29 comprises the data transmission module 25. Moreover, it comprises a second contact carrier, which is separate. This second contact carrier is configured to be made from plastic. It is conceived to comprise all electrical contacts directly, which means that both the data transmission module 25 as well as the at least two signal transmission contacts 14, 15, 27, 28 comprise the two energy transmission contacts 11 and 12 as well as the ground contact 13. These may, for instance, be snapped into engagement thereon.

The electrical plug 1 comprises a first contact carrier, which is integral part of the data transmission module 25. The first contact carrier is in particular formed as a single piece from plastic. The several, in particular eight, data transmission contacts 16 to 23 can be attached directly thereto. Moreover, the electrical plug 1, in particular the data transmission module 25, comprises a tube-like sleeve, which is equally not shown in FIG. 3. This tube-like sleeve comprises this first contact carrier. On the circumferential side, it fully surrounds the first contact carrier. This tube-like sleeve is in particular configured to be made from metal. This sleeve is attached by the first contact carrier directly to the second contact carrier. Thus, also this data transmission module 25 is arranged within the outer sleeve 29 and surrounded on the circumferential side by the outer sleeve 29.

On the outer sleeve 29, an electrical connection to the ground contact 13 is realized so that, moreover, also a corresponding electrical contact with the metallic first plug housing section 3 is formed. Thereby the grounding is achieved.

In an embodiment, on the outer side of the sleeve of the data transmission module 25, a separate shielding part for electromagnetic shielding of the data transmission module 25 towards the remaining electrical contacts of the electrical plug 1 is arranged. For instance this shielding part may be a meshwork made of metal.

In an embodiment, the pin arrangement 10 comprises exactly two signal transmission contacts, exactly two energy transmission contacts, exactly one ground contact, and exactly eight data transmission contacts. In one further embodiment the pin arrangement 10, may comprise exactly two energy transmission contacts, exactly one ground contact, exactly eight data transmission contacts, and exactly four signal transmission contacts. The signal transmission contacts 14, 15 or 14, 15, 27, and 28 are intentionally provided for transmitting signals of an engine brake of an electric motor and/or for signals of a temperature sensor of the electric motor and/or for signals of a temperature sensor of the electric motor and/or for an overload protection of the electric motor. In particular, such signals are transmitted via these signal transmission contacts 14, 15 and/or 27, 28. In particular, via data transmission contacts 16 to 23, data signals are transmitted at a transmission rate of equal or larger than 1 Gbit/s.

Figure 4:
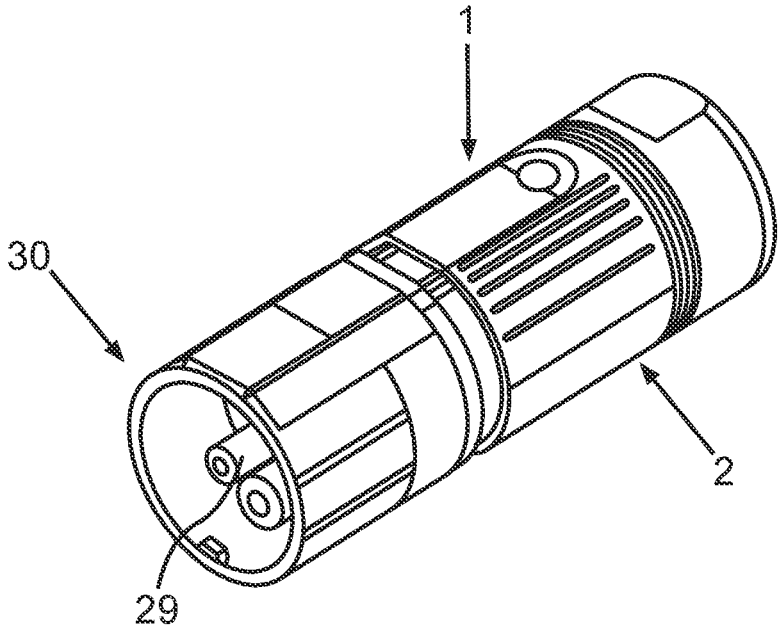
FIG. 4 is a perspective view of an electrical plug according to another embodiment with the pin arrangement of FIG. 1 or FIG. 2.

In FIG. 4 a further embodiment of a plug 1 is shown. The electrical plug 1 in the embodiment of FIG. 4 is not an angle plug, as it has been set out in FIG. 3. The electrical plug 1 in the embodiment of FIG. 4 is a linear plug. It may, for instance, be provided for direct connecting or coupling to the electrical plug 1 according to FIG. 3. For instance, the electrical plug 1 according to FIG. 4 may be directly coupled with a coupling portion 30 to the coupling portion 9.

Figure 5:
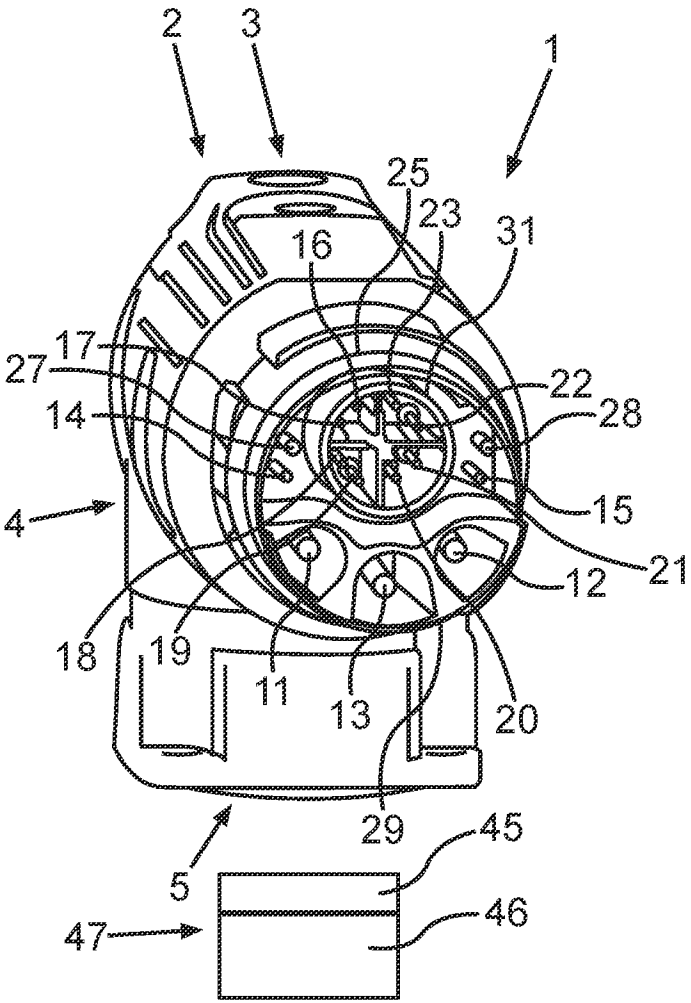
FIG. 5 is another perspective view of the electrical plug of FIG. 3.

In FIG. 5, a further perspective view an electrical plug 1 according to FIG. 3 is shown. Here a configuration as a male plug is shown. The electrical contacts, which are the energy transmission contacts 11 and 12, the ground contact 13, here the four signal transmission contacts 14, 15, 27, and 28, and the eight data transmission contacts 16 to 23, are contact pins. In FIG. 5, moreover, the already explained sleeve 31 of the data transmission module 25, also referred to as a tube-like sleeve above, is shown.

In FIG. 6 an embodiment of the electrical plug 1 is shown, which here is also an angle plug. A difference from FIG. 5 is that the electrical plug in FIG. 6 is configured with a female pin arrangement 10. This means that the named electrical contacts are not configured as contact pins, but as contact sockets, in particular insertion openings.

In FIG. 6, moreover, also an embodiment for a first contact carrier 24 of the data transmission module 25 is shown. In this regard here, too, also the quarter segments 33, 34, 35, and 36 can be recognized. For the sake of clarity, here the reference signs for the data transmission contacts 16 to 23 are not drawn in FIG. 6.

In FIG. 7, an exploded view of the embodiment of an electrical plug 1 according to FIG. 4 is shown. However, here not all components of the electrical plug 1 are represented for clarity of the drawing. The data transmission module 25 comprising the first contact carrier 24, the data transmission contacts 16 to 23, and the tube-like sleeve 37 is shown. In the embodiment shown here, moreover, a shielding element for electromagnetic shielding of the data transmission contacts 16 to 23 is shown. The shielding element here is a separate, tube-like shielding sleeve 31. Same, too, is here an integral part of the data transmission module 25. The shielding sleeve 31 is made of metal. Thus, electromagnetic shielding of the data transmission contacts 16 to 23 to the remaining electrical contacts of the electrical plug is achieved. A data transmission that is particularly reduced in interference is thereby achieved.

The first contact carrier 24 with the data transmission contacts 16 to 23 arranged directly thereon is inserted into the tube-like sleeve 37, which, in turn, is then inserted into the shielding sleeve 31. The data transmission module 25 is insertable into a receiving portion 38 of the second contact carrier 39. The second contact carrier 39, moreover, is configured for direct attachment, in particular snapping into engagement, of the energy transmission contacts 11 and 12, of the ground contact 13 and of the signal transmission contacts 14, 15, and, if provided, 27 and 28. Moreover, the already mentioned outer sleeve 29 is shown. Into the outer sleeve 29, the second contact carrier 39 is capable of being inserted in its equipped state.

In FIG. 7, the electrical contact 40 is shown, which connects the ground contact 13 in an electrically conducting manner with the metallic housing part 41 of the electrical plug 1. In this tube-like housing part 41, the contact module with the outer sleeve 29 is inserted. Moreover, in FIG. 7, also additional seals and screwing components are shown. Furthermore, a further housing part 42 is shown, which can be screwed together with the first housing part 41 such that thereby the plug housing of this electrical plug 1 is formed. This plug housing then is also the external housing of the electrical plug 1. In this regard, in the other embodiments, the plug housing sections 3 and 4 as well as the flange sleeve 5 are the components forming the external housing.

Moreover, in FIG. 7 an exemplary embodiment of a crimp sleeve 32 is shown. Furthermore, a cable clamp 43 and a shielding ring 44 are shown.

Figure 8:
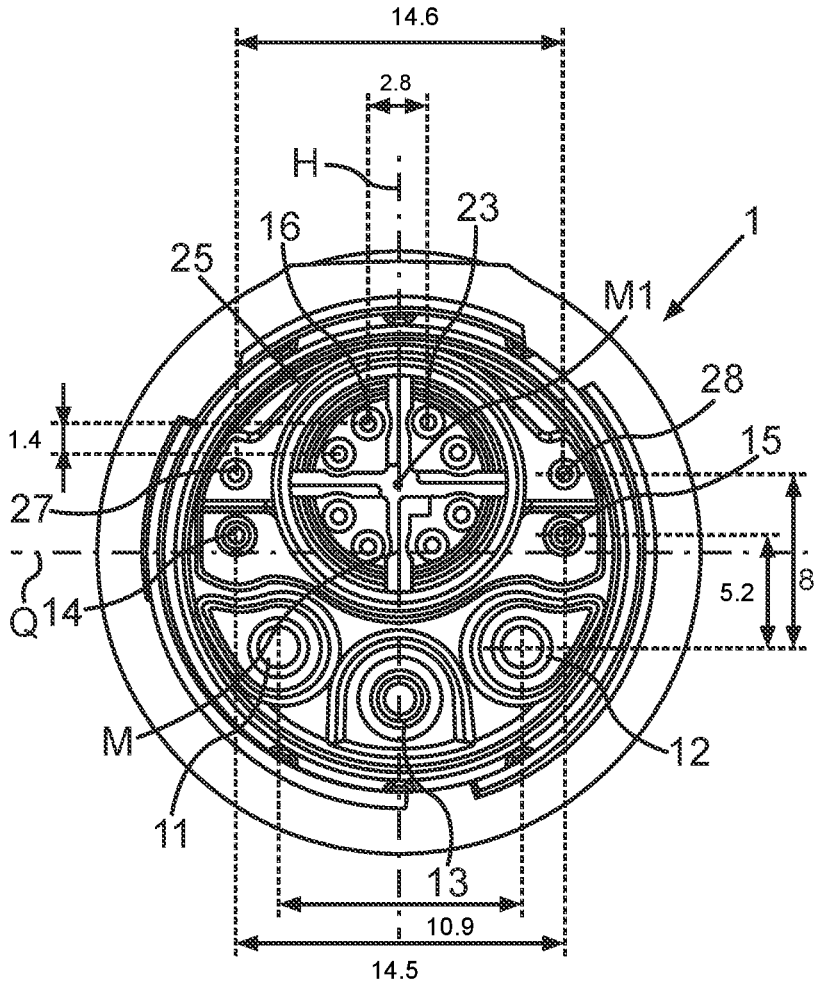
FIG. 8 is a front view of the electrical plug of FIG. 2 with exemplary dimensions.

In FIG. 8, the electrical plug 1 according to FIG. 2 is shown. For the sake of clarity, only some of the reference signs are drawn. In this way, the dimensions, which are to be understood as examples, can be recognized. In one embodiment, a distance, which is measured perpendicularly to the height axis H (extending through the center M) between the two data transmission contacts 16 and 23, which are most distant from the energy transmission contacts 11, 12, is between 2.5 mm and 3.0 mm, in particular between 2.7 mm and 2.9 mm. In an embodiment this also applies to the data transmission contacts 19 and 20, which are closest to the energy transmission contacts 11, 12. These are closest to the transverse axis Q (extending through the center M) in comparison with the other data transmission contacts 16, 17, 18, 21, 22, 23.

In an embodiment, a distance between the two data transmission contacts 16 and 17 measured perpendicularly to the transverse axis Q is between 1.2 mm and 1.6 mm, in particular 1.3 mm and 1.5 mm. The same applies to a distance measured in this regard between the data transmission contacts 18 and 19 as well as to the data transmission contacts 20 and 21, and to the data transmission contacts 22 and 23. These distances thus relate to two data transmission contacts each, which form a data transmission contact pair each.

In an embodiment, a distance between the signal transmission contacts 14 and 15 measured perpendicularly to the height axis H is between 14.0 mm and 15.0 mm, in particular between 14.5 mm and 14.7 mm, if they are provided. In one embodiment a distance between the signal transmission contacts 27 and 28 measured perpendicularly to the height axis H is between 14.0 mm and 15.0 mm, in particular between 14.5 mm and 14.7 mm, if they are provided. The distance in this regard between the signal transmission contacts 27 and 28 can be equal to the distance between the signal transmission contacts 14 and 15. These distances, however, may be different in another embodiment. In particular the difference may amount to between 0.05 mm and 1.5 mm.

In an embodiment, a distance between the energy transmission contacts 11 and 12 measured perpendicularly to the height axis H is between 10.6 mm and 11.2 mm, in particular between 10.8 mm and 11.0 mm.

In an embodiment, a distance between a signal transmission contact 14 and/or 15 and an energy transmission contact 11 and/or 12 measured perpendicularly to the transverse axis Q is between 4.9 mm and 5.5 mm, in particular between 5.1 mm and 5.3 mm. A signal transmission contact 14 or 15 and an energy transmission contact 11 or 12 assigned for this determination of distance are arranged for this purpose in the same pin arrangement half in relation to the height axis H.

In an embodiment, a distance between a signal transmission contact 27 and/or 28 and an energy transmission contact 11 and/or 12 measured perpendicularly to the transverse axis Q is between 7.7 mm and 8.3 mm, in particular between 7.9 mm and 8.1 mm. A signal transmission contact 27 or 28 and an energy transmission contact 11 or 12 assigned for this determination of distance are arranged for this purpose in the same pin arrangement half in relation to the height axis H.

These above-named distances each are measured between the centers or the longitudinal axes of these named electrical contacts, which here are contact pins.

Figure 9:
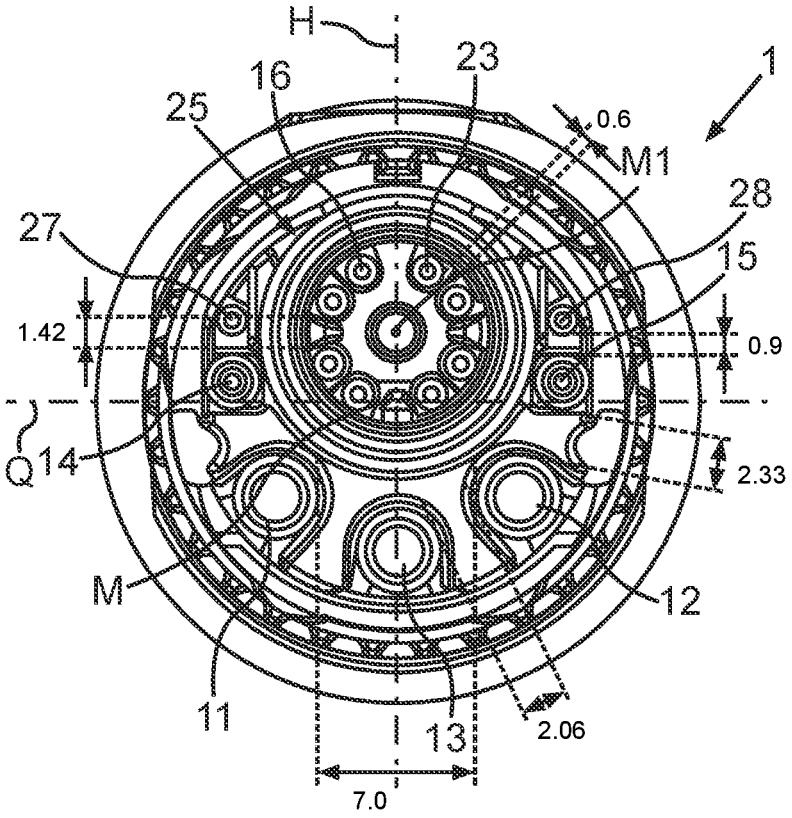
FIG. 9 is a back view of the electrical plug of FIG. 2 with exemplary dimensions.

In FIG. 9, the electrical plug 1 according to FIG. 2 is shown in a back view. For the sake of clarity only some of the reference signs are drawn. In this way, the dimensions, which are to be taken as examples, can be recognized. Here, in contrast to FIG. 8, no male pin arrangement is shown, but a female pin arrangement is represented. Distances are to be understood as between parallel tangents on the outer sides of the electrical contacts. The electrical contacts here are not contact pins, but contact holes.

In an embodiment, a distance between two adjacent data transmission contacts 22 and 23, in particular a data transmission contact pair, is between 0.4 mm and 0.8 mm, in particular between 0.5 mm and 0.7 mm.

In an embodiment, a distance between a signal transmission contact 27 and the further signal transmission contact 14 arranged in the same pin arrangement half (viewed in relation to the height axis H) measured perpendicularly to the transverse axis Q is between 0.7 mm and 1.1 mm, in particular between 0.8 mm and 1.0 mm. The same applies to the other signal transmission contacts 15 and 28.

In an embodiment, a distance between a data transmission contact 17 and the adjacent data transmission contact 18 measured perpendicularly to a transverse axis (extending through M1) of the pin arrangement 26 of the data transmission module 25 is between 1.3 mm and 1.6 mm, in particular between 1.4 mm and 1.5 mm. These data transmission contacts 17, 18 are the data transmission contacts which are symmetrically opposite the transverse axis of the pin arrangement and closest to this transverse axis. These data transmission contacts 17 and 18 are arranged on a pin arrangement half of the pin arrangement 26 of the data transmission module 25, which is formed by a height axis of the pin arrangement 26. In the embodiment the height axis H of the entire pin arrangement 10 is equal to the height axis of the pin arrangement 26. This also applies to the embodiment in FIG. 8. A corresponding distance is configured for the further data transmission contacts 21 and 22 in FIG. 9.

In an embodiment a distance between a signal transmission contact 15 and an energy transmission contact 12 arranged in relation to the height axis H in the same pin arrangement half is between 2.1 mm and 2.5 mm, in particular between 2.3 mm and 2.4 mm. If two signal transmission contacts 15 and 28 are arranged in the pin arrangement half, this distance between the energy transmission contact 12 and the signal transmission contact 15 which is closest to the energy transmission contact 12 applies. The same applies with regard to the electrical contacts 14, 11, and 27.

In an embodiment, a distance between the energy transmission contacts 11 and 12, measured perpendicularly to the height axis H, is between 6.7 mm and 7.3 mm, in particular between 6.9 mm and 7.1 mm.

In an embodiment, a distance between an energy transmission contact 11, 12 and the ground contact 13 is between 1.8 mm and 2.3 mm, in particular between 2.0 mm and 2.1 mm.

The named dimensions also apply individually viewed to other embodiments of the arrangement of electrical contacts in a pin arrangement 10.

The explained electrical plugs are in particular integral parts of an arrangement comprising moreover at least one housing part 45 of a housing 46, in particular for an electric motor 47, as shown in FIG. 5 schematically and exemplarily.

The electrical plug 1 according to the embodiment of the invention has a compact setup with a more manifold information transmission, in particular with regard to an operation of an electric motor. In this regard a more flexible use for more modern and different electric motors can be facilitated.

In an embodiment, the electrical plug 1 is configured as direct current (DC) plug. In an embodiment the electrical plug 1, in particular with regard to its several data transmission contacts 16 to 23, is intentionally configured according to the Cat6 standard. It may also be configured for an in this regard higher standard, for instance Cat 6a, Cat7, or Cat7a, or Cat8.

A further aspect of the invention relates to a system, which is configured for point-to-point transmission of information. Equally the system, however, may also be a so-called Daisy-Chain configuration.

The electrical plug 1 as described here may be used in manifold application fields, for instance in the fieldbus communication in industrial automation. Equally it may be used for the communication between individual drives. Moreover, it may also be used in a centralized, a decentralized, or a motor-integrated structure. A further application may for instance be in video systems or generally in optical systems, for instance in the case of medical diagnostic appliances, optical quality control systems, or passenger information systems and entertainment systems.

What is claimed is:

1. An electrical plug, comprising:

a pair of electrical energy transmission contacts that are separate from one another;

a plurality of signal transmission contacts that are separate from one another;

at least eight data transmission contacts that are separate from one another, an arrangement of the electrical energy transmission contacts, the signal transmission contacts, and the data transmission contacts forms a pin arrangement of the electrical plug;

a first contact carrier;

a second contact carrier separate from the first contact carrier and on which the first contact carrier is arranged;

an outer sleeve receiving the first contact carrier and the second contact carrier; and a first plug housing receiving the outer sleeve.

2. The electrical plug of claim 1, wherein the data transmission contacts are configured for data transmission at a transmission rate of at least 1 Gbit/s.

3. The electrical plug of claim 1, wherein the data transmission contacts are arranged according to predetermined standard pin arrangement.

4. The electrical plug of claim 1, wherein the pin arrangement has two or exactly four signal transmission contacts.

5. The electrical plug of claim 1, further comprising a ground contact arranged on a height axis of the pin arrangement.

6. The electrical plug of claim 1, wherein the electrical energy transmission contacts, the signal transmission contacts, and the data transmission contacts are contained in the first plug housing.

7. The electrical plug of claim 1, wherein the signal transmission contacts transmit signals of an engine brake of an electric motor, signals of a temperature sensor of an electric motor, and/or signals for an overload protection of an electric motor.

8. The electrical plug of claim 1, wherein a plurality of pairs of the data transmission contacts are data transmission contact pairs.

9. The electrical plug of claim 8, wherein each of the plurality of data transmission contact pairs are connected to twisted pair wires.

10. The electrical plug of claim 1, wherein the data transmission contacts are arranged on the first contact carrier.

11. The electrical plug of claim 10, further comprising a tube-like sleeve, the first contact carrier is arranged in the tube-like sleeve.

12. The electrical plug of claim 11, wherein the first contact carrier and/or the tube-like sleeve has four separate quarter segments, two of the data transmission contacts are arranged in each of the quarter segments.

13. The electrical plug of claim 11, wherein the tube-like sleeve with the first contact carrier is arranged on the second contact carrier.

14. The electrical plug of claim 13, wherein the signal transmission contacts and the electrical energy transmission contacts are arranged on the second contact carrier.

15. The electrical plug of claim 11, further comprising a shielding element electromagnetically shielding the data transmission contacts from the electrical energy transmission contacts and the signal transmission contacts.

16. The electrical plug of claim 15, wherein the tube-like sleeve is contained in the shielding element and an outer face of the tube-like sleeve contacts an inner surface of the shielding element.

17. The electrical plug of claim 16, wherein the shielding element is a shielding sleeve made of metal.

18. An electrical plug, comprising:

a pair of electrical energy transmission contacts that are separate from one another;

a plurality of signal transmission contacts that are separate from one another; and at least eight data transmission contacts that are separate from one another, an arrangement of the electrical energy transmission contacts, the signal transmission contacts, and the data transmission contacts forms a pin arrangement of the electrical plug, wherein:

the signal transmission contacts are arranged symmetrically to a height axis of the pin arrangement;

the data transmission contacts are arranged symmetrically to the height axis; and the electrical energy transmission contacts are arranged symmetrically to the height axis.

19. The electrical plug of claim 18, wherein the pair of signal transmission contacts are arranged on a first side of the pin arrangement defined by a horizontal axis, and the pair of electrical energy transmission contacts are arranged on a second side of the pin arrangement on a side of the horizontal axis opposite the first side.

20. An arrangement, comprising:

a housing part of a housing for an electric motor; and an electrical plug connected to the housing part, the electrical plug including:

a pair of electrical energy transmission contacts that are separate from one another;

a plurality of signal transmission contacts that are separate from one another;

at least eight data transmission contacts that are separate from one another, an arrangement of the electrical energy transmission contacts, the signal transmission contacts, and the data transmission contacts forms a pin arrangement of the electrical plug;

a first contact carrier on which the data transmission contacts are arranged, a tube-like sleeve within which the first contact carrier is arranged; and a shielding element electromagnetically shielding the data transmission contacts from the electrical energy transmission contacts and the signal transmission contacts, the tube-like sleeve contained within the shielding element.

* * * * *